US011508217B2

(12) United States Patent
Harris et al.

(10) Patent No.: US 11,508,217 B2
(45) Date of Patent: Nov. 22, 2022

(54) GAMING SYSTEM FOR PRESENTING CLASS II GAMES

(71) Applicant: Aries Technology LLC, Las Vegas, NV (US)

(72) Inventors: Ronnie W. Harris, Las Vegas, NV (US); Kent Reisdorph, Las Vegas, NV (US); Janae Hoover, Las Vegas, NV (US); Rochelle Terman, Las Vegas, NV (US)

(73) Assignee: Aries Technology, LLC, Las Vegas, NV (US)

( * ) Notice: Subject to any disclaimer, the term of this patent is extended or adjusted under 35 U.S.C. 154(b) by 0 days.

(21) Appl. No.: 16/992,860

(22) Filed: Aug. 13, 2020

(65) Prior Publication Data

US 2021/0134104 A1 May 6, 2021

Related U.S. Application Data

(60) Provisional application No. 62/888,830, filed on Aug. 19, 2019.

(51) Int. Cl.
*G07F 17/32* (2006.01)

(52) U.S. Cl.
CPC ..... *G07F 17/329* (2013.01); *G07F 17/3223* (2013.01); *G07F 17/3239* (2013.01)

(58) Field of Classification Search
CPC . G07F 17/329; G07F 17/3223; G07F 17/3239
See application file for complete search history.

(56) References Cited

U.S. PATENT DOCUMENTS

| | | | |
|---|---|---|---|
| 5,830,067 | A | 11/1998 | Graves et al. |
| 6,001,016 | A | 12/1999 | Walker et al. |
| 6,183,362 | B1 | 2/2001 | Boushy |
| 6,306,038 | B1 | 10/2001 | Graves et al. |
| 6,311,976 | B1 | 11/2001 | Yoseloff et al. |
| 6,361,437 | B1 | 3/2002 | Walker et al. |
| 7,066,815 | B2 | 6/2006 | Walker et al. |
| 7,128,652 | B1 | 10/2006 | Lavoie et al. |
| 7,524,244 | B2 | 4/2009 | Walker et al. |
| 7,588,495 | B2 | 9/2009 | Walker et al. |
| 7,727,071 | B2 | 6/2010 | Giobbi |
| 7,806,761 | B2 | 10/2010 | Walker et al. |
| 2002/0094860 | A1 | 7/2002 | Itkis et al. |
| 2004/0148251 | A1 | 7/2004 | Kavoun |
| 2004/0248645 | A1 | 12/2004 | Blackburn et al. |
| 2005/0059467 | A1 | 3/2005 | Saffari et al. |
| 2005/0187014 | A1 | 8/2005 | Saffari et al. |
| 2005/0193209 | A1 | 9/2005 | Saunders et al. |

(Continued)

*Primary Examiner* — Werner G Garner
(74) *Attorney, Agent, or Firm* — Weide & Miller, Ltd.

(57) ABSTRACT

A gaming system particularly configured to present a Class II bingo game such as bingo includes a game host, at least two player hosts, and a sentinel. The sentinel receives a request for a bingo card purchase from a player of a player interface and upon authorizing the player request transmits the request to one of the player hosts. The player host then makes a bingo card purchase with the game host and plays a bingo card provided by the game host in relation to a set of called bingo balls. The outcome of the play of the bingo card is provided to the sentinel and the game outcome is displayed as an alternative entertaining display at the player's player interface.

16 Claims, 3 Drawing Sheets

(56) References Cited

U.S. PATENT DOCUMENTS

| | | | | |
|---|---|---|---|---|
| 2005/0250569 | A1 | 11/2005 | Kane et al. | |
| 2006/0154727 | A1 | 7/2006 | Okuniewicz | |
| 2006/0205477 | A1 | 9/2006 | Fisk et al. | |
| 2007/0202941 | A1* | 8/2007 | Miltenberger | G07F 17/3255 463/25 |
| 2013/0130766 | A1 | 5/2013 | Harris | |
| 2014/0221071 | A1* | 8/2014 | Calio | G07F 17/3225 463/19 |

* cited by examiner

GAMING SYSTEM FOR PRESENTING CLASS II GAMES

RELATED APPLICATION DATA

The present invention claims priority to U.S. Provisional Application Ser. No. 62/888,830, filed Aug. 19, 2019, which is incorporated herein by reference in its entirety.

FIELD OF THE INVENTION

The present invention relates to systems and devices for presenting wagering games.

BACKGROUND OF THE INVENTION

A variety of devices and systems are known for presenting wagering games. The configurations of such devices and systems often varies depending upon the type of game which is being presented.

In the United States, the Indian Gaming Regulatory Act (25 U.S.C. § 2701 et. seq., hereinafter the "IGRA") defines Class II gaming on Indian lands. The IGRA includes the following definitions:

§ 2701(7)(A):

The term "class II gaming" means:

(i) the game of chance commonly known as bingo (whether or not electronic, computer, or other technologic aids are used in connection therewith), (ii) which is played for prizes, including monetary prizes, with cards bearing numbers or other designations, (iii) in which the holder of the card covers such numbers or designations when objects, similarly numbered or designated, are drawn or electronically determined, and (iv) in which the game is won by the first person covering a previously designated arrangement of numbers or designations on such cards, including (if played in the same location) pull-tabs, lotto, punch boards, tip jars, instant bingo, and other games similar to bingo, and

§ 2701(4):

The term "Indian lands" means—

(A) all lands within the limits of any Indian reservation; and (B) any lands title to which is either held in trust by the United States for the benefit of any Indian tribe or individual or held by any Indian tribe or individual subject to restriction by the United States against alienation and over which an Indian tribe exercises governmental power.

Currently, a wide variety of gaming systems exist which are configured to present Class II games, such as games of bingo. FIG. 1 illustrates one simplistic diagram of a Class II gaming system of the prior art. As illustrated therein, the system comprises a Game Services Provider (which may comprise a framework, such as implemented relative to a server, for hosting and communicating various game services, including managing bingo card, bingo ball calls and bingo game sessions), a Game Host (which receives bingo game play requests, provides game play elements such as bingo cards and bingo ball draw information and provides verification of outcomes of game play, including associated awards) and a plurality of player Gaming Machines (which comprise player interfaces by which players may purchase bingo cards, provide player game inputs and are presented with verification bingo game outcomes and related awards).

A number of problems exist when considering existing Class II gaming systems relative to Class II gaming under IGRA. For example, IGRA regulations contemplate that a bingo game must be played with two or more players competing against each other for common prizes. In addition, as noted in the definition above, play of the bingo game contemplates the player providing one or more game inputs, such as covering the numbers or other designations on their card (generally referred to as "daubing"). Often, Class II gaming systems link player gaming machines in multiple locations. One problem that can arise is a loss in network connectivity between the game host and one or more player gaming machines. This can prevent, for example, the gaming host receiving confirmation that a player provided a required daubing input. This could result, for example, in the player not being credited with game play and a game win.

Existing Class II gaming systems are also limited to game play at player gaming machines. Thus, a player must travel to a venue which offers Class II gaming (e.g. on Indian lands or in other jurisdictions where wager gaming is otherwise allowed), which severely limits the participation of players. In contrast, consumers are currently allowed to participate in a wide range of events from their home computers or mobile communication devices. There is thus a desire to allow players to participate in Class II gaming from such devices.

Unfortunately, existing Class II gaming systems such as those described above do not readily facilitate such an option or problems arise when attempting to implement this functionality. For example, simply linking players' mobile phones and computers to the game system host presents a number of security risks to the system host. Another issue is that players of mobile devices and computers may not be on Indian lands where Class II gaming is permitted. In addition, simply adding "mobile" functionality to such an existing gaming system only exacerbates problems associated with network communications given that communication links to mobile and/or remote devices are inherently much less reliable.

Another issue is limited screen space to depict the game elements of the bingo card, bingo numbers, player specific information such as credit balance, and alternative entertaining displays of the outcome of the bingo game, such as spinning slot reels. In particular, under existing regulations, the bingo card and called bingo numbers/balls must be displayed to the player of the game. It is commonly desired to present the player with an alternative entertaining display of the outcome of the bingo game. However, this requires that the alternative entertaining display be presented along with the display of the bingo card and called bingo numbers/balls.

A gaming system which overcomes these and other problems is desired.

SUMMARY OF THE INVENTION

Aspects of the invention comprise gaming systems, player interfaces or devices, and methods of generating game information and presenting and playing games. In one embodiment, the gaming system has particular applicability to the presentation of Class II games, and particularly games of bingo or bingo in addition to other games (such as pull-tabs, lotto, etc.).

In one embodiment, a gaming system is configured to present a bingo game. The system comprises a game host, at least two player hosts, and a sentinel, wherein the sentinel is configured to receive a request for a bingo card purchase from a player of a player interface and to authorize the player request, wherein the sentinel transmits authorized player requests for card purchases to one of the at least two player hosts, wherein the player host makes a bingo card purchase with the game host in response to receiving a request for a card purchase from the sentinel, wherein the player host plays a bingo card provided by the game host in relation to a set of called bingo balls, including performing any player actions required, wherein an outcome of the play of the bingo card is provided to the sentinel, and wherein the outcome is displayed as an alternative entertaining display at the player's player interface.

In another embodiment, a method of presenting a bingo game to a player comprises the steps of: receiving, at a sentinel server, a request for a bingo card purchase from a player of a player interface; determining, by the sentinel server, whether the request for the bingo card purchase is authorized; when the purchase is authorized, transmitting, from the sentinel server, the player request for a bingo card purchase to one of at least two player hosts; generating, by the player host, a bingo card purchase; transmitting the purchase from the player host to the game host; receiving, at the player host, information regarding at least one bingo card based upon the purchase request; playing, at the player host, the at least one bingo card in relation to a set of called bingo balls, the step of playing comprising receiving at least one game play input to the player host; determining an outcome of the play of the at least one bingo card; transmitting, to the sentinel server, the outcome; storing, by the sentinel server in a database, the outcome; and transmitting from the sentinel server to the player interface, information for causing the player interface to display as a representative entertaining display of the outcome.

Further objects, features, and advantages of the present invention over the prior art will become apparent from the detailed description of the drawings which follows, when considered with the attached figures.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Aspects of the invention comprise gaming systems, player interfaces or devices and methods of generating game information and presenting and playing games. In one embodiment, the gaming system has particular applicability to the presentation of Class II games, and particularly games of bingo or bingo in addition to other games (such as pull-tabs, lotto, etc.).

Figure 1:
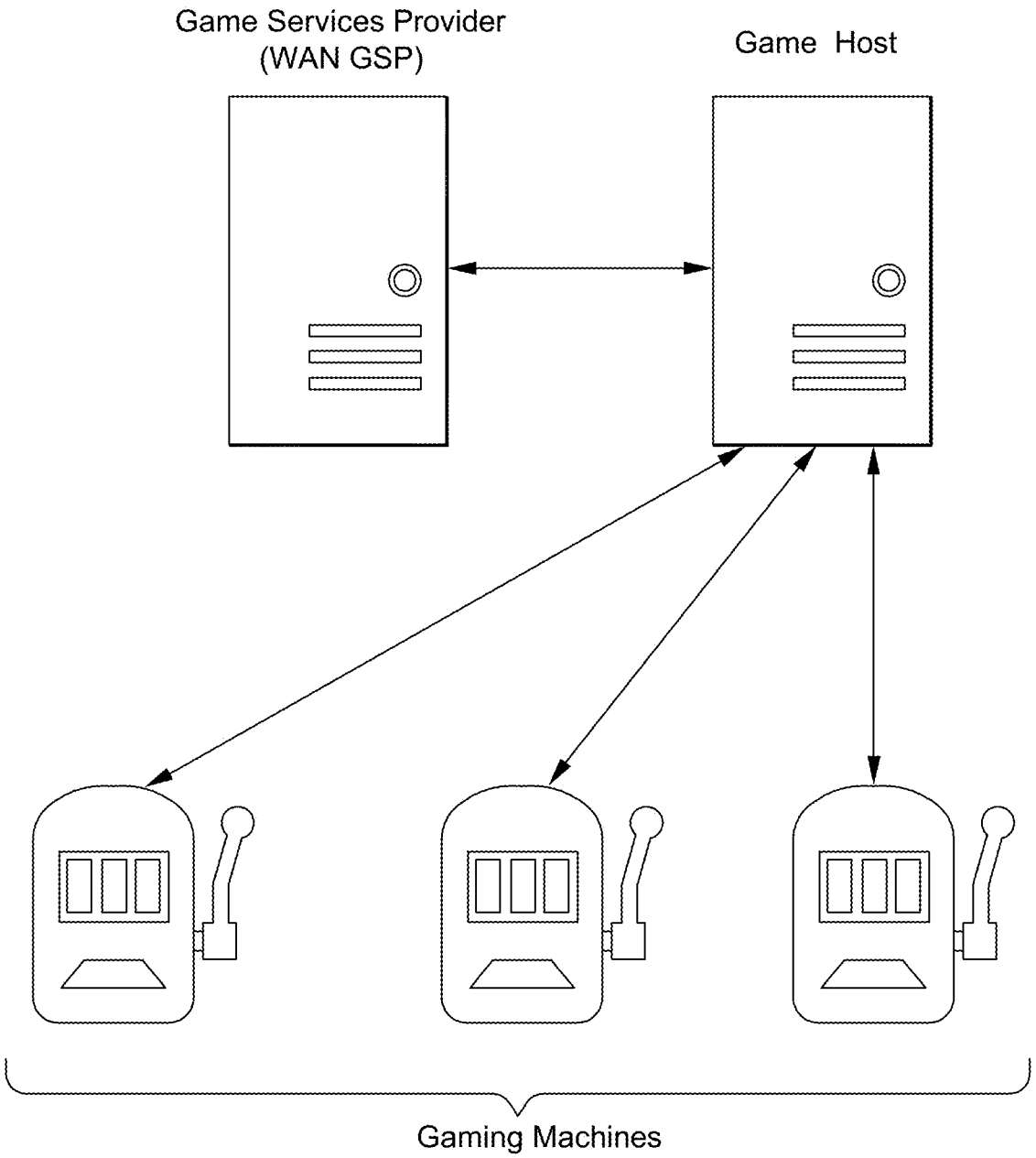
FIG. 1 diagrammatically illustrates one embodiment of a gaming system for presenting bingo game in accordance with the prior art.
Figure 2:
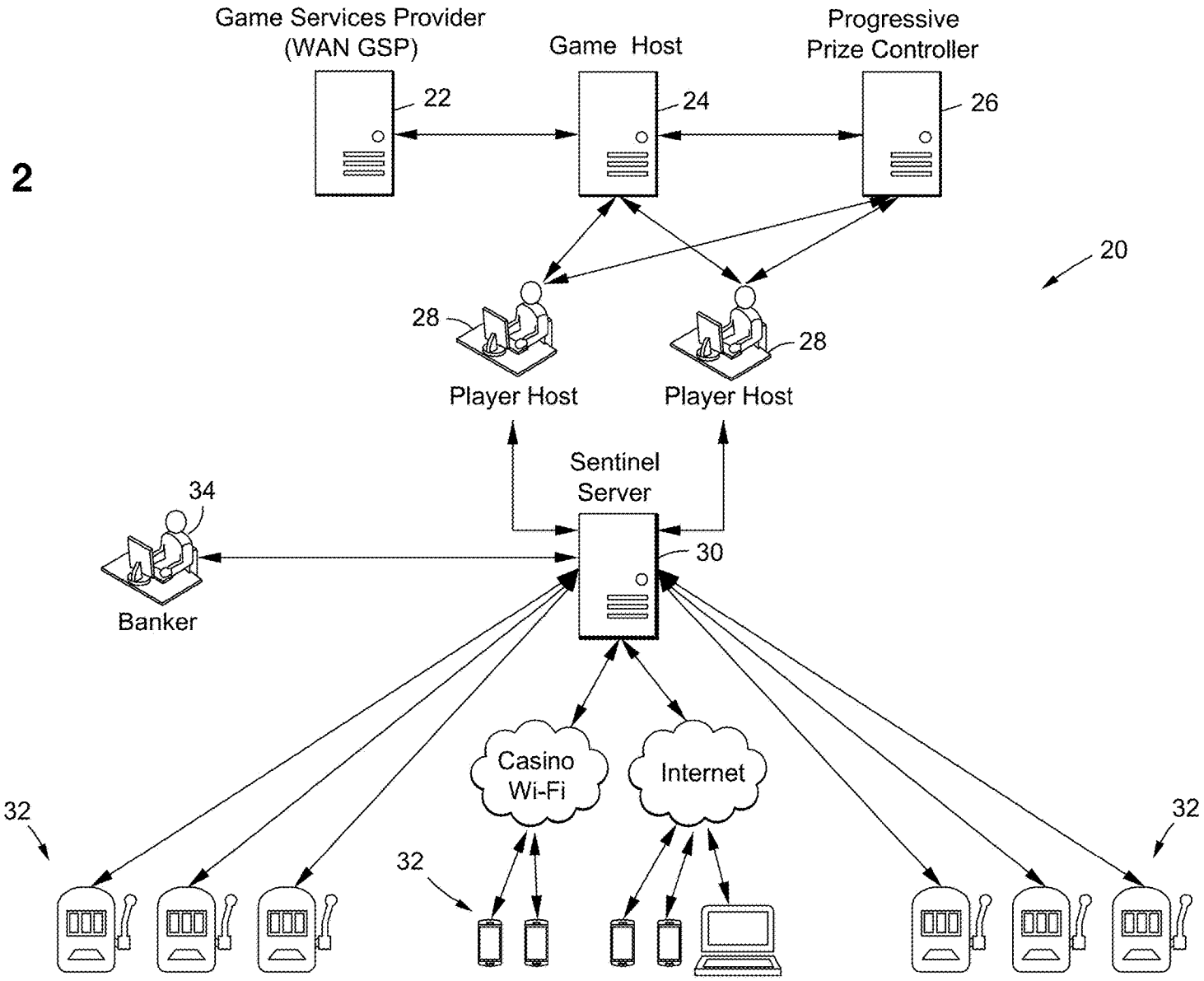
FIG. 2 diagrammatically illustrates one embodiment of a gaming system of the present invention.

One embodiment of the invention will be described with reference to FIG. 2. As illustrated therein, a gaming system 20 comprises at least one game server, a sentinel, and at least two player hosts. The system 20 may include or is in communication with a plurality of player interfaces.

In one embodiment, back-end gaming functions are performed by the at least one game server. While the game server might comprise a single server, in one embodiment, the back-end functions may be performed by more than one server. In particular, as illustrated in FIG. 2, the system 20 may comprise a game services provider 22, a game host 24 and a progressive prize controller 26, each of which may comprise a server comprising one or more processors or controllers, at least one communication device or interface, a database or other data storage device, and one or more additional memory or data storage devices (such as separate from the database). In one or more embodiments, the processor(s) is configured to execute one or more instructions, such as in the form of machine readable code (i.e. "software"), to allow the server to perform various functionality, such as the functionality described herein. The software is preferably non-transitory, such as by being fixed in a tangible medium. For example, the software may be stored in the one or more memory devices. One or more of the memory devices may be read-only. In addition, the software may be stored on a removable medium in some embodiments. In general, the one or more memory devices are used as temporary storage. For example, the one or more memory devices may be random access memory or cache memory used to temporarily store some user information and/or instructions for execution by the at least one processor.

The software may comprise one or more modules or blocks of machine readable code. Each module may be configured to implement particular functionality when executed by the one or more processors, and the various modules may work together to provide overall integrated functionality. Of course, in certain embodiments, it is also possible for various of the functionality to be implemented as hardware, i.e. a processor or chip which is particularly designed to implement various of the functionality described herein.

In one embodiment, each of the servers may include (or be linked communicatively at one or more times to) one or more input and/or output devices, such as a keyboard, mouse, touchscreen, video display or the like, whereby the processor may receive information from an operator or servicer of the server and/or output information thereto. This allows, for example, an operator of the server to interface with the server to upgrade, maintain, monitor, etc., it. In other embodiments, an operator might interface with the server via a separate workstation or other device.

In one embodiment, the game services provider 22, the game host 24 and the progressive prize controller 26 can communicate with one another. Further, as illustrated in FIG. 2, at least the game host 24 and progressive prize controller 26 can preferably communicate with the player hosts 28.

The player hosts 28 preferably comprise a computing device, such as a computing workstation or a server which has a host interface (such as at least one video display and one or more input devices, such as keyboard, mouse, etc.), and a processor, a memory, a communication interface, and machine-readable code (e.g. "software") stored in the memory and executable by the processor thereof.

In a preferred embodiment, the system back end, such as the game services provider 22, game host 24 and progressive prize controller 26, are located in Indian lands, as is each player host 28. The player hosts 28 might be distributed, however, such as by having one or more hosts at different locations on Indian lands.

In turn, the player hosts 28 communicate with the sentinel 30. In one embodiment, the sentinel 30 is also implemented as a server having a processor, a memory, a communication interface and software. While the sentinel 30 may be located on Indian land, for reasons noted below, the sentinel need not be located on Indian land. In one embodiment, the system 20 might include more than one sentinel 30. For example, a game operator might centrally operate the back end bingo game system (game services provider 22, game host 24 and progressive controller 26) at a first location. However, players might be permitted to play the game at a number of different casinos in different locations (along with game play via their mobile device or other remote devices as disclosed herein). The game operator might thus provide a sentinel 30 at each casino to handle the game play requests from players at that casino and players in the vicinity.

The sentinel 30 then communicates with the player interfaces 32. The player interfaces may comprise, for example, a personal player interface such as a PDA, phone, laptop or desktop computer, tablet or the like, or a casino gaming machine or terminal. Preferably, the player interfaces comprise at least one electronic video display and one or more player input devices (such as a keyboard or keypad, touchscreen, and/or other input devices). Of course, such devices 32 may comprise additional elements, such as a controller or processor, a communication interface, a memory device (such as for storing machine readable code or "software" for execution by the processor, such as in the form of a downloaded software application—such as a "sentinel client" as is described in more detail below), and an input/output interface (such as for receiving input from a touchscreen, one or more buttons or the device or the like).

In the case of player interfaces in the form of a gaming machine, the machine may be a custom-configured device such as those which are well known and are located at casinos. These devices generally have a cabinet, at least one video display, one or more player input devices, and a controller or processor, memory, machine-readable code executable by the processor, and a communication interface. Such a gaming machine may be configured to present a single game or multiple different games, preferably comprising wagering games. In order to facilitate wagering, the gaming machine may include one or more monetary value funds accepting devices such as a bill validator, coin acceptor, card or FOB reader or the ability to receive funds electronically via an account, whereby one or more wagers may be placed from a balance of funds (wherein the balance of funds may be represented as one or more credits, where those credits have associated monetary value).

Preferably, the player interfaces 32 are configured to receive information for display and cause the information to be displayed. The interfaces 32 generally include a video controller or other processor for processing the information for display. The information may be provided to the video or other controller via a communication interface, such as a wired communication link (such as Ethernet, etc.) or a wireless link (WiFi, Bluetooth, etc.).

In one embodiment, the game services provider 22 is a framework for hosting and communicating with the game host 24. In one embodiment, the game services provider 22 implements (such as via software running at the server), the following functionality:

1) A Game Session Manager
2) A Bingo Card Package Allocator
3) A Game ID Allocator
4) A Ball Draw Manager In one embodiment, the game host 24 provides the central determination for game outcomes. All other system components generally either respond to the actions of the game host or are not involved in game determination in any way. For any game style, the game host 24 is responsible for all randomization capabilities that have an effect on game outcome (e.g. bingo ball calls, etc.).

As indicated, the system 20 may include a progressive prize controller 26. The progressive prize controller 26 may manage claims against (e.g. the "winning of") progressive jackpots, track contributions to progressive jackpot prize pools, and track the progressive prize pools' balances. The progressive prize controller 26 may be capable of supporting multiple levels of progressive prizes, such as via controllers that manage and coordinate progressives at one or more wide areas and which manage and coordinate progressives at one or more local areas.

In one embodiment, the player interfaces 32 comprise a sentinel client. The sentinel client may be configured as software which is executed by a processor of the player interface 32. In the case of personal player interfaces 32 (such as PDAs or other mobile communication devices, tablets, laptop and desktop computers), the sentinel client may be a downloadable application which the player downloads and installs on their device for execution by the processor thereof. In the case of casino-style gaming machines, the application may be installed into the memory of the gaming machine for execution by the controller thereof. In other embodiments, functionality may be implemented via a web-browser and the sentinel 30 acting as a webserver.

The sentinel client may be configured to receive a request from a player to play a game. In the case of a Class II bingo game, the request may be a request by a player to purchase a bingo card for play in a bingo game (via input to the player interface by the player). The sentinel client preferably transmits the request to the sentinel 30 and also receives game outcomes of games played from the sentinel 30. The sentinel client may be configured to present one or more graphical user interfaces on the display of the player interface, such as a game interface which prompts the player to place wagers/buy bingo cards, to present game results, etc.

The sentinel 30 may be configured to implement the following functionality:

1) Authorize a player to make a game play request, such as by receiving a purchase request from an authorized player interface (which as detailed below, may comprise determining that the play request is coming from a player located on Indian land (either by validating the particular device from which the request is made or by geo-locating the device) or is coming from stored player instructions), and confirm payment for the game play request (such as payment for one or more bingo cards to be played)

2) Transmit authenticated game play requests for which payment has been confirmed to one of the player hosts 28

3) Obtain the game outcome from the game host 24 or player host 28

4) Send the result back to the player interface 32 via the sentinel client (or otherwise provide the game results to the player, as described below).

5) Track purchase requests and ensure start-to-finish transactional integrity.

6) Provide bingo game details for the purpose of game recall or game play investigations.

7) Request registration data from the player interface 32 via the sentinel client.

8) Save the registration data for the player interface 32 for future lookup.

9) Persist bingo game purchases and results for reporting purposes.

In one embodiment, the player hosts 28 serve as the actual players or "players in fact" of the game. In one embodiment, the player hosts 28 comprise two or more live player hosts and one or more electronic player hosts. Preferably, the player hosts 28 facilitate the play of bingo cards by at least two live player hosts—e.g. two people who actually participate in the game by providing physical inputs to play the game. The player hosts 28 preferably also facilitate game play via one or more electronic player hosts—e.g. the electronic player hosts 28 preferably automate the play of bingo cards in the bingo game without direct live player input or participation (as instructed or directed by the player without direct live player input or participation in the game being played for them by the player host). As one example, in order to start a bingo game or "game session", at least two requests to play bingo cards are provided to the player hosts 28 and each of the live player hosts plays one of the bingo cards. Thereafter, additional requests for play of other bingo cards in the game may be routed to the electronic player hosts 28 and played in automated fashion (e.g. without direct input or involvement by a live player).

In one embodiment, the system 20 is configured to present one or more bingo games. In one embodiment, players of the player interfaces 32 may make a request to participate in the game, such as by a request to buy at a bingo card for play in the bingo game. This input is received by the sentinel client of the player interface 32 and is forwarded to the sentinel 30, which in turn forwards the request to one of the player hosts 28 (as described below, in one or more embodiments, the sentinel 30 only generates and forwards a game play request to the player host 28 if the player's request is authenticated—e.g. such as by authenticating the location of the request and confirming payment). The player host 28 then purchases the bingo card(s) from the game host 24 and plays the cards.

The game host 24 presents the bingo game, under the supervision of the game services provider 22. In the case of a bingo game, the game host 24 assigns a bingo card to a player host each time one of the player hosts 28 buys a bingo card for a player. The cards may be, for example, randomly generated or assigned.

Preferably, the bingo game is presented in standard fashion, wherein the game host 24 selects or "calls" bingo balls. The game host 24 transmits information regarding the assigned card and the called bingo balls to the player host 28. The player host 28 then plays the game, such as by providing any required daub and/or claim win inputs (or other inputs, as may be required). The player host 28 then reports the play of the game back to the game host 24, which confirms the outcome. Either the player host 28 or the game host 24 then transmits information regarding the game outcome (e.g. the outcome of the play of the purchased bingo card) to the sentinel 30. In one embodiment, the outcome of the play of a bingo card is represented as either a "zero win" (e.g. the outcome of the game was losing, wherein the player lost their card purchase and was not awarded any winnings) or a win amount (e.g. the outcome of the game was winning, wherein the player was awarded winnings). As is known, in the case of the game of bingo, the outcome of the game is determined by comparing matches of indicia (e.g. matches of called bingo balls to indicia marked on the card) to a pay table of winning outcomes—such as a pay table of pattern matches wherein winning pattern matches have associated awards.

Preferably, the sentinel 30 stores (or can access) the game outcome and associated game information relative to the play of a particular bingo card in an associated database. This permits the game outcome and associated game data to be recalled for verification purposes. The information may be stored in a database which is associated with the sentinel 30 or which is accessible thereby. This data may comprise, but is not limited to:

1) A unique transaction ID for the bingo card play (to which all information regarding the bingo card and its play is tied), including but not limited to one or more of:

a) Date/Time of purchase b) Game outcome (e.g. a "win amount" or "zero")

c) Bingo card d) Balls drawn e) Bingo game number f) The pattern mask for the played bingo card (e.g. information representing the daubed display of the indicia matched on the bingo card).

Most importantly, the sentinel 30 reports the game outcome to the sentinel client. In one embodiment, only the win amount and game ID is sent to the player's player interface 32. The player's player interface 32 then presents the game outcome to the player. In one embodiment, this comprises the presentation of an alternative entertaining display of the game result.

The system and method may have additional features.

As noted above, the sentinel 30 maintains or can access a database of all bingo cards purchased from the game host 24 and played in the bingo game and the associated results of the play of those bingo cards. An authorized user can review those bingo game results.

In one embodiment, game rules and pay table information may be provided either via a website or might be provided via a graphical interface which is supported by the sentinel client.

The system 20 might include or be linked to other devices or systems. For example, the system 20 could be linked to a casino player tracking system. These systems are well known in the art and may be configured to track player game play or other activities (retail spending at a casino, etc.) and may be configured to award promotional prizes to a player.

As noted above, the sentinel 30 preferably confirms a player's payment for a bingo card. The player might fund bingo card purchase (or other wagers) in various ways. For example, if the player interface that the player is using is an in-casino gaming machine or terminal, that machine or terminal may include a monetary value accepting mechanism as noted above. The player might thus provide cash, coins, value tickets or the like to the machine, such as to create or increase a credit funds balance at the machine. When the player makes a request for a purchase of a bingo card, that request may be transmitted along with confirmation of funds from the gaming machine to the sentinel 30. When the player is playing an in-casino gaming machine on Indian land, awards of winnings from winning bingo cards may be credited to the balance of funds at that machine for wagering by the player or cash-out.

In another embodiment, the player might establish a funds account. The funds account might be created and maintained by the operator of the gaming system 20, by the casino, or even by an external financial entity, such as via a financial server 34. The player might deposit funds to the account while on Indian land or by obtaining funds on credit, such as from the casino or the external financial entity. In one embodiment, as described above, when a player makes a request to purchase a bingo card, the sentinel 30 may confirm that funds exist in the player's account to purchase the bingo card and the purchase or wager may be deducted from the player's account and moved to a casino or system operator's account. In this embodiment, any winnings from game play may be deposited to the player's account. When the player is playing a player interface which is not on Indian land, the player may not be directly awarded winnings. In this case, winnings may be deposited to the player's account and the player may collect those funds by travelling to a facility on Indian land, such as a casino cashier.

In yet another embodiment, the system 20 may have the ability to obtain funds for the player via a bank account or card (debit card, credit card, etc.). For example, the player may associate information regarding a bank card or account or the like with their funds account. The financial server 34 might then initiate a transaction to request funds via that external account and have funds transferred into their player account.

Of course, other mechanisms may be provided for funding purchases or wagers, thus allowing the sentinel 30 to confirm bingo card purchase funding and authorize the player host 28 to make a bingo card purchase for the player.

As indicated above, in a preferred embodiment, a player may only make a request to play a game from Indian land or if the player has left game play instructions for the player host. The system 20, and preferably the sentinel 30, authorizes a player to make a request for game play. The sentinel 30 may, for example, either confirm that the player is playing an authorized device via a device ID (such as by confirming the gaming machine ID of a gaming machine which is known to be located on Indian land) or via geo-location, geo-fencing or other location determination methodologies, by which the sentinel 30 can otherwise confirm that the player is located on Indian land (such as by confirming the location of the player's mobile device). If the player's location cannot be verified as being on Indian land, then a request for game play can only come from stored player instructions. In other words, if the player attempts to request game play from a non-authorized location (off Indian land), the request is denied.

For example, a player might use their player interface (such as a mobile phone) to request the player host 28 to play 10 $1 bingo cards while the player is eating at a restaurant of a casino on Indian land. The player's location may be confirmed by geo-fencing, such as by confirming an IP address of their mobile phone or via triangulation of a signal from their phone. That same player might also leave instructions for the player host to purchase 10 $1 bingo cards the following day. The player might then leave the casino and travel off of Indian land. The player host 28 may still then play the 10 $1 bingo cards the following day per the player's instructions, by using funds from the player's account to make the bingo card purchases.

Figure 3:
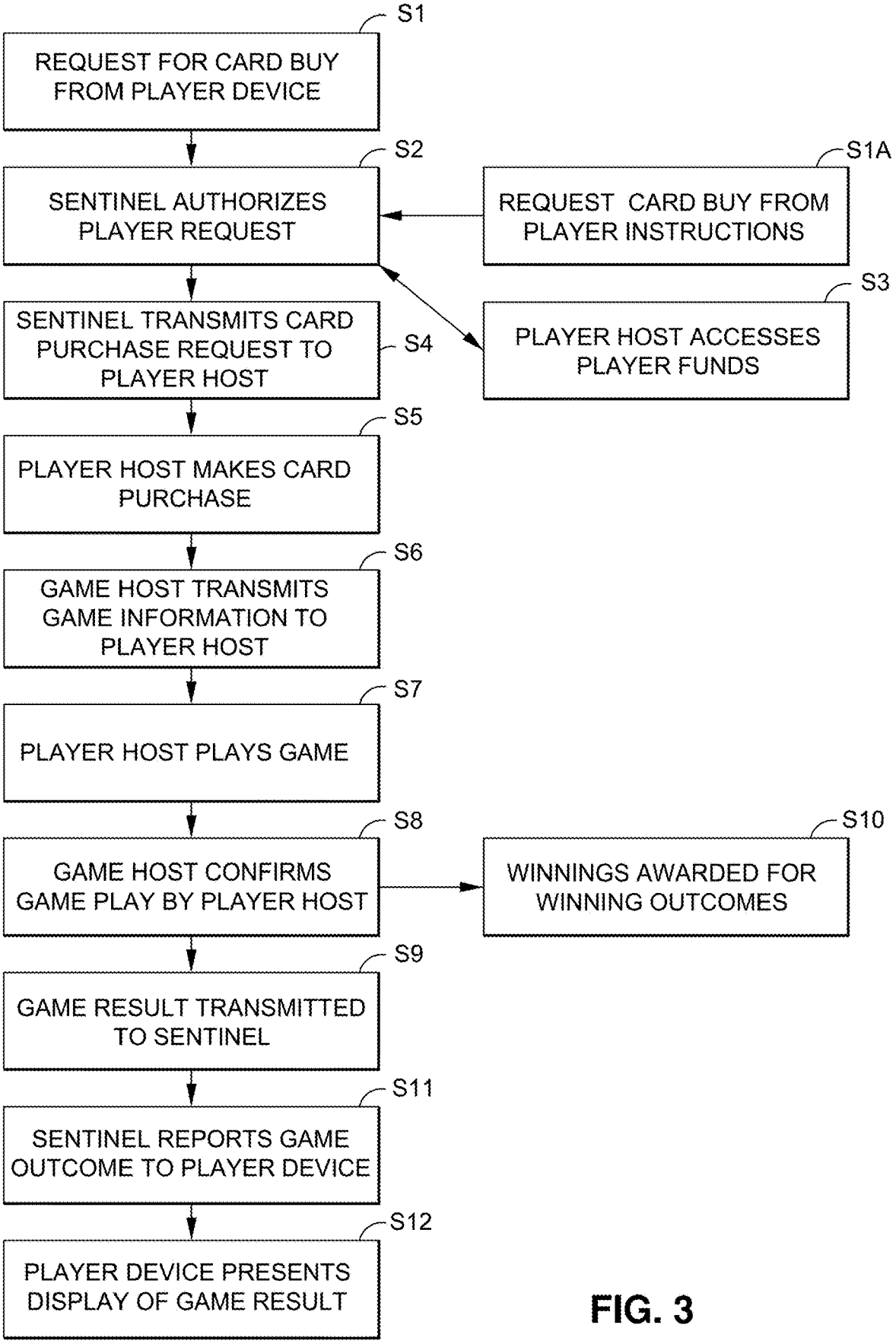
FIG. 3 is a flow diagram which illustrates aspects of the invention.

One example of use of the system 20 to present and play a bingo game is illustrated in FIG. 3. In a step S1, a player may make a request to buy a bingo card from their player interface 32. This request is transmitted to the sentinel 30. As described above, the player request might also be obtained from player instructions, as in a step S1A.

In a step S2, the sentinel authorizes the player request for a bingo card purchase. As indicated above, this preferably comprises determining that the player's request is made via a player interface which is located on Indian land or is coming from stored instructions. In addition, as indicated in step S3, the sentinel 30 also verifies funding of the card purchase, such as in the manners described above.

If the request is authorized (including by being funded), the sentinel 30 sends the player request for a bingo card purchase to one of the player hosts 28, as in step S4. The player host 28 then makes a bingo card purchase via the game host 24, as at step S5.

In step S6, in response to the player host's 28 request the game host 24 preferably obtains information regarding a selected bingo card and bingo ball draw and sends that information to the player host 28 for game play. In step S7, the player host 28 then plays the bingo game. As described herein game play may require that the player host 28 provide one or more player inputs, such as a "daub" and/or "claim" input. The player host's 28 game play is then confirmed by the game host 24, as in step S8, such as to verify the game outcome (e.g. that the balls drawn matched indicia on the card in one or more winning patterns) and eligibility for claiming a win (e.g. that the player host 28 made the required game play inputs).

The outcome of the game may comprise a losing outcome (e.g., zero credits) or a winning outcome (e.g., a number of awarded credits). For example, the outcome of the play of one purchased bingo card might comprise the winning outcome of "10 credits". In step S9, the outcome of the play of the bingo card is transmitted to the sentinel 30, such as from the game host 24 and/or player host 28. Further, any winnings are also awarded to the player as at step S10—such as by either sending instructions to increase a credit balance of funds at the in-casino gaming machine that the player is playing or via increasing the funds balance of the player's account.

The sentinel 30 receives the game outcome and stores the game outcome for that player. The sentinel 30 transmits the game outcome to the player's player interface, as at step S11. When the player is playing an in-casino gaming machine, the outcome may be immediately transmitted to the device. The sentinel client at the device may then display the result of the game (e.g. such as in the form of an alternative entertaining display which represents the game outcome).

If the player is utilizing a personal device, such as a mobile phone, the game outcome may be transmitted to the sentinel client of that device for presentation of the outcome.

In other embodiments, a player might access the game outcomes in other manners. For example, a player might login to the sentinel 30 (such as by providing a player ID) via a web browser or the like. The sentinel 30 might then cause information regarding the game outcome to be transmitted to the player, such as by causing the web browser of the player's player interface to display an alternative entertaining display of the game result. This might comprise, for example, displaying a video representation of a slot-type game, a pull-tab type game, a scratcher game or any of a variety of events, wherein the alternative entertaining display comprises the represented award of 10 credits.

Of course, if the player makes a request to play multiple bingo cards, then this process is implemented relative to each request—e.g. each request is authorized and funded, each bingo card is played and the outcome of each bingo card is presented to the player.

As described below, in one embodiment, play of the game is implemented via the player hosts 28. For example, relative to a bingo game, play of the bingo game may require that a player provide an input to daub matching indicia and/or to claim a prize. In accordance with the present invention, the live or electronic player hosts 28, provide such inputs. In one embodiment, as player bingo card purchase requests are received by the sentinel 30, those requests are allocated to the different player hosts 28. In some cases, the request(s) may be processed by one of the live player hosts 28, while in others the request(s) may be processed by one of the electronic player hosts.

As will be appreciated, player requests for game play are tracked so that game outcomes are matched to individual players, such as via a player tracking account or other player ID, such as a player ID associated with a player's financial account. In this manner, each card purchase made by a player host is tied to a particular player, as is the outcome of that game.

The system 20 may have other configurations than that described above. For example, the system 20 need not include a progressive jackpot controller 26 if the games do not offer players the chance for one or more progressive jackpots.

In one embodiment, various elements of the system 20 might be combined. For example, in one embodiment, the player hosts 28 might be implemented via the sentinel 30. For example, a single server might enable the functionality of the sentinel and might act as one or more of the player hosts 28—such as the electronically implemented player hosts. The "live player" player hosts 28 might be implemented relative to one or more workstations which are tied to the sentinel server. In this case, however, in the preferred embodiment the sentinel servers would then be located on Indian land.

The invention has numerous advantages over the prior art and solves a great number of problems.

First, the present invention allows Class II games to be presented to players of not only traditional gaming devices or terminals (such as physically located at a casino), of users of other devices such as computers, laptops and tables, and personal communication devices such as PDAs and phones.

In accordance with the invention, the player interfaces do not interact directly with the back-end game system components such as the game host, progressive prize controller or the like. In particular, a player's request to purchase a bingo card (or to otherwise place a wager on a Class II game) is not transmitted directly to the game host. Instead, requests for bingo card purchases (or other wagers) are made to the sentinel and are assigned to a player host. The player host then interacts with the game host to make a bingo card purchase.

Further, unlike existing Class II game systems where game-related player inputs are provided by the player to the game host via the gaming machine that they are playing, in this case all game-related inputs are made by the player hosts. As noted above, in accordance with the game system of the invention, players simply make requests to purchase bingo cards (or otherwise make a Class II game wager) and are presented with game outcomes. All game play is effectuated by the player hosts (including card purchases and any inputs required to daub and/or claim a prize).

This configuration has several advantages. First, the player interfaces do not interact with or link to the back-end game system devices/servers. This protects those components from intrusion or tampering by players and protects those components from viruses.

Also, in this configuration, the players are not playing the bingo games. Instead, the player hosts are playing the bingo games. The player hosts are located on Indian lands where Class II gaming is permissible. On the other hand, the players themselves might be located anywhere, including off of Indian lands. The configuration of the present invention thus permits the players to make bingo card purchase requests and obtain game outcomes without the need for geofencing or other solutions which limit the player to participating in the game via Indian land.

Another advantage of the invention is that the player hosts can ensure that all games are properly played. One problem with existing Class II gaming system is that players often do not provide the required player inputs in order to complete the game. For example, a player may forget to provide a "daub" or "claim" input, resulting in what is known as a "slept card"—which prevents the player from obtaining any winning award for that game card. Because game play of the invention is implemented by back-end player hosts 28, proper game play of all game cards can be ensured.

Another advantage is that all game cards can be played in sequence. In current Class II gaming systems, if two players both obtain progressive prize winning patterns, the player who completes game play first (such as by providing the required player inputs) may be awarded the prize against the other player—even if the other player made their card purchase first. In accordance with the invention, player hosts 28 might play game cards in the order in which player play requests are received and/or authorized by the sentinel 30.

Because the player interfaces need only to run the sentinel client, the player interfaces can include computing devices and mobile communication devices, rather than custom-built gaming machines. Further, even in a casino environment, the gaming machines which a casino may provide for player use in the casino could be simple thin-client terminals which are much less expensive to manufacture and operate. For example, these devices might comprise a decorative cabinet which essentially houses a standard computing device which runs the sentinel client.

The gaming system is readily scalable because a large infrastructure of back-end game hosts at various casinos and associated gaming machines is not needed. Instead, players can simply interface with one or more sentinel servers in order to implement the game (where the number of sentinel servers may be scaled up and down depending upon the play volume).

The system of the invention also solve problems associated with network connectivity, such as drop-outs. As noted above, because the players do not play the game via their player interfaces, issues associated with transmitting and receiving information related to player inputs (such as inputs to daub and/or claim) or game outcome verification, do not occur. This is remedied by having the player hosts play the game. The player interfaces simply transmit card purchase requests (which requests are implemented when received and thus do not affect the play of the game as to that player or other players if the request is delayed by communication loss) and obtain and present the outcomes of games played as alternative entertaining displays (wherein a delay in receiving the outcome of a game at the player interface again does not impact the play of the game).

Another advantage to the present system and method relates to the display of game outcome information to players. In accordance with the invention, the player hosts 28 play the game. Compliance with current regulations can thus be accomplished by displaying the required bingo card and the called bingo balls/numbers to the player hosts 28. On the other hand, the players are only presented with outcomes of games played by the player hosts 28. In other words, the players only see 'historical" game results in the sense that the games have already been played. Thus, the players do not need to be presented with a display of the bingo card(s) and called bingo numbers/balls. Instead, the players can simply be presented with entertaining displays of the game outcomes. This reduces the information that needs to be presented to the players and frees up display space for the alternate entertaining display of the game outcome.

Further, because a player is only presented game outcomes at their player interface, the player may control the timing of their viewing of the game outcomes. For example, game outcomes might be transmitted to a player's player interface as soon as they are generated by the game host and transmitted by the sentinel. The player, however, might not desire to view those game outcome until a later time. As one example, a player host might play 10 bingo games for a player at 10 am. The player might view those game outcomes in the evening after work. In one embodiment, this might comprise the player opening the sentinel client on their player interface and then selecting an option to "view pending game outcomes." At that time, the game outcomes could be displayed to the player, such as in the form of a sequence of alternative entertaining displays that represent the outcomes of each of the game.

While the invention has particular applicability to the play of Class II games, aspects of the invention may pertain to the presentation and play of other types of games, including non-wagering games. Further, the invention may apply to Class II games other than bingo, including pull-tabs, lotto, punch boards, tip jars, instant bingo, and other games similar to bingo, as defined by IGRA. As one example, utilizing the system of the invention, a player might make a request to purchase a pull-tab, which request is processed by a player host relative to a game host. The outcome of the pull-tab may be reported to the player via the sentinel server, whereupon the result of the pull-tab may be presented to the player at their player interface.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A method of presenting a bingo game to a player comprising the steps of:

receiving, at a sentinel server, a request for a bingo card purchase from a player of a player interface;

determining, by said sentinel server, whether said request for said bingo card purchase is authorized;

when said bingo card purchase is authorized, transmitting, from said sentinel server, said request for said bingo card purchase to a first player host of at least two player hosts, each of said at least two player hosts comprising computing devices which are configured to receive one or more inputs from live players, said live players separate from said player;

generating, by said first player host, said bingo card purchase;

transmitting said bingo card purchase from said first player host to a game host;

receiving, at said first player host from said game host, information regarding at least one bingo card based upon said bingo card purchase;

playing, at said first player host, said at least one bingo card in relation to a set of called bingo balls generated by said game host, said step of playing comprising receiving, via said first player host, at least one game play input by said live player to said first player host;

determining an outcome of the play of said at least one bingo card;

transmitting, to said sentinel server, said outcome;

storing, by said sentinel server in a database, said outcome; and transmitting from said sentinel server to said player interface, information for causing said player interface to display as a representative entertaining display of said outcome.

2. The method in accordance with claim 1, wherein said at least one bingo card is played by said first player host without input by said player.

3. The method in accordance with claim 1, wherein said player interface comprises a mobile communication device.

4. The method in accordance with claim 1, wherein said step of authorizing comprises determining payment for said bingo card purchase.

5. The method in accordance with claim 1, wherein said step of authorizing comprises determining that said request was made from an authorized location.

6. The method in accordance with claim 1, further comprising receiving payment for said bingo card purchase from a player account and, when said outcome of the play of said at least one bingo card is winning, associating winnings with said player account.

7. The method in accordance with claim 6, comprising determining that said request for said bingo card purchase is not authorized when said request is made from non-Indian land.

8. The method in accordance with claim 1, further comprising awarding winnings when said outcome of the play of said at least one bingo card is winning, and associating said winnings with said player interface when said player interface comprises a gaming device, and associating said winning with a player account when said player interface comprises other than a gaming device.

9. A gaming system configured to present a bingo game comprising:

a game host configured to generate information regarding said bingo game;

at least two player hosts, each player host comprising a processor, a memory and machine-readable code stored in said memory of said each player host and executable by said processor of said each player host;

a sentinel comprising a computing device comprising a processor, a memory and machine-readable code stored in said memory of said sentinel and configured to cause said processor of said sentinel to receive a request for a bingo card purchase from a player of a player interface and to authorize said request and transmit an authorized player request for said bingo card purchase to one of the at least two player hosts;

said machine-readable code of said one of said at least two player hosts configured to cause said processor of said one of said at least two player hosts to request said bingo card purchase with the game host in response to receiving said authorized player request from the sentinel;

said machine-readable code of said one of the at least two player hosts configured to receive at least one bingo card from said game host and to play said bingo card provided by the game host in relation to a set of called bingo balls and one or more inputs to said one of the at least two player hosts, said one or more inputs made by a live player host comprising a live player other than said player; and wherein said machine-readable code stored in said memory of said sentinel is configured to receive information regarding an outcome of said play of said bingo card and cause said processor of said sentinel to cause said outcome to be displayed as a representative entertaining display at the player interface of the player.

10. The gaming system in accordance with claim 9, wherein said player interface comprises at least one of: a gaming terminal, a mobile communication device, a laptop, a tablet, and a desktop computer.

11. The gaming system in accordance with claim 9, wherein said game host and said at least two player hosts are located on Indian land and said sentinel is configured to authorize said player request by determining if said player request is initiated on said Indian land.

12. The gaming system in accordance with claim 11, wherein when an outcome of said play of said bingo card is winning, said game host is configured to associate winnings with a player account maintained on said Indian land.

13. The gaming system in accordance with claim 9, further comprising a database, wherein said sentinel saves information regarding said outcome of the play of the bingo card in said database.

14. The gaming system in accordance with claim 9, wherein said player host plays said bingo card without input by said player.

15. The gaming system in accordance with claim 9, wherein said sentinel comprises at least one server.

16. The gaming system in accordance with claim 9, wherein said player interface does not communicate directly with said game host.

* * * * *